US005220750A

United States Patent [19]

Emberland et al.

[11] Patent Number: 5,220,750

[45] Date of Patent: Jun. 22, 1993

[54] PRESSURE PLATEN FOR USE IN AN ABRASIVE FINISHING MACHINE

[75] Inventors: James E. Emberland, Kernersville, N.C.; Joseph P. Litecky, Brooklyn Park, Minn.

[73] Assignee: Timesavers, Inc., Minneapolis, Minn.

[21] Appl. No.: 984,383

[22] Filed: Dec. 2, 1992

Related U.S. Application Data

[63] Continuation of Ser. No. 781,742, Oct. 23, 1991, abandoned.

[51] Int. Cl.[5] ..... B24B 21/10

[52] U.S. Cl. ..... 51/141; 51/138; 51/142

[58] Field of Search ..... 51/141, 138, 328, 135 R, 51/142

[56] References Cited

U.S. PATENT DOCUMENTS

| | | | |
|---|---|---|---|
| 629,885 | 8/1899 | Becker | 51/142 |
| 1,628,531 | 5/1927 | Carlson | 51/142 |
| 1,927,330 | 9/1933 | Williams | 51/138 |
| 1,936,991 | 11/1933 | Pinkney | 51/141 |
| 2,586,848 | 2/1952 | Miller | 51/141 |
| 2,624,160 | 1/1953 | Harper | 51/141 |
| 2,926,465 | 3/1960 | Sommers | 51/142 |
| 3,094,815 | 6/1963 | Pendergast | 51/60 |
| 3,832,807 | 9/1974 | Kiser et al. | 51/138 |
| 3,832,808 | 3/1974 | Kiser | 51/138 |
| 3,872,627 | 3/1975 | Schuster | 51/135 R |
| 4,512,110 | 4/1985 | Stump | 51/141 |
| 4,651,474 | 3/1987 | David | 51/138 |
| 4,742,650 | 5/1988 | Sauder, Jr. et al. | 51/138 |
| 4,864,775 | 9/1989 | David | 51/142 |

FOREIGN PATENT DOCUMENTS

| | | | |
|---|---|---|---|
| 1135331 | 8/1962 | Fed. Rep. of Germany | 51/141 |
| 3103556 | 8/1982 | Fed. Rep. of Germany | 51/138 |

*Primary Examiner*—Robert A. Rose
*Attorney, Agent, or Firm*—Haugen and Nikolai

[57] ABSTRACT

A pressure platen for use in an endless abrasive belt surface finishing device which includes a platen assembly arranged to move in a reciprocal pattern relative to the work surface. The assembly includes means for continuously driving the platen along a reciprocal path with platen guide wheels being provided which engage a stationary track for maintaining horizontal orientation of the platen. The surface of the platen is preferably provided with a graphite containing cloth cover. The improved platen assembly enhances the performance of the system through improvements to the quality of the finish, a significant increase in belt life, and also an increase in the lifetime for the graphite impregnated cover.

4 Claims, 4 Drawing Sheets

PRESSURE PLATEN FOR USE IN AN ABRASIVE FINISHING MACHINE

This is a Continuation of copending application Ser. No. 07/781,742, filed on Oct. 23, 1991 now abandoned.

FIELD OF THE INVENTION

The present invention relates to an improved pressure platen system for use in an abrasive finishing machine, and more particularly to such a system wherein the pressure platen is driven or moved along a reciprocatory to-and-fro path as the endless belt moves thereacross. In this arrangement, the pressure platen is driven or moved along its own axis, and therefore along an axis normal to that of the endless abrasive belt. As is normal in machines of this type, that portion of the platen making contact with the moving belt is coated with a layer of graphitic material, such as a graphite impregnated cloth thereby forming an outer cover for the platen and the resilient pad component of the platen. The graphite impregnated cloth cover significantly reduces the coefficient of friction between the outer surface of the platen and the inner surface of the moving belt. The improved structure of the present invention has been found to reduce ridging and gouging of the surface of the graphite impregnated cloth platen cover which results in ridging and gouging of the work. The present invention also significantly improves belt life, thereby increasing the up-time performance of the abrasive finishing machine.

BACKGROUND OF THE INVENTION

Wide belt sanders utilizing stationary platens are known in the prior art, with two such systems being disclosed in U.S. Pat. No. 4,651,474 to David and U.S. Pat. No. 4,864,775 to David, assigned to the same assignee as the present invention. Additionally, there have been systems developed in the past that provide oscillating movement to the entire abrasive belt or sanding head. Examples of such devices are found in U.S. Pat. No. 2,926,465 to Sommers; U.S. Pat. No. 3,094,815 to Pendergast; and U.S. Pat. No. 4,742,650 to Sauder, Jr. et al.

In a typical wide-belt abrasive finishing machine, one or more heads may be provided. The finishing head typically includes a platen interposed between a pair of rollers or drums. One or more of the drums is power driven, with the balance normally being idlers. The platen is normally interposed between a pair of horizontally aligned belt guiding rollers rotatably mounted upon parallelly disposed axes. The work passes beneath the platen and is pressed into contact with the abrasive belt while moving beneath the surface of the platen.

Typically, work is fed into the machine by a feed system or conveyor assembly that comprises an endless horizontally-oriented conveyor belt having one or more abrasive heads disposed in opposed relationship to the belt. The upper span or flight of the belt cooperates with pinch rolls so as to grip the work and feed it through the machine at a uniform rate. The top surface of the work contacts one or more moving abrasive belts during this operation. The conveyor assembly is adjustable either upwardly or downwardly toward or away from the abrasive belt assembly, in order to accommodate and adapt the apparatus to workpieces having different thicknesses. U.S. Pat. No. 3,832,808 discloses a wide belt sanding apparatus with adjustable conveyors and reference is made to this disclosure in that patent for the details of the conveyor design.

Previous abrasive finishing devices have provided oscillatory movement to the entire belt and platen system. Such systems typically have involved the oscillatory movement of the entire sanding head and entire belt supporting means including laterally disposed idlers such as in U.S. Pat. No. 4,651,474. Additionally, the tracking systems for the belts have included means for controllably maintaining the belt within a carefully delineated or controlled tracking zone. However, none of these prior abrasive finishing machines have provided controlled oscillatory movement to the platen as the belt moves across its surface.

Another attempt to improve the quality of abrasive finishing devices or machines has been to increase the width of the platen. However, such efforts have not reduced the problem of grooving or streaking of the belt contacting surface, hence the present invention finds application in connection with platens of a variety of widths.

SUMMARY OF THE INVENTION

The endless abrasive finishing apparatus of the present invention is intended to perform a finishing operation wherein the platen, which urges the belt into contact with the surface of the work is moved in a reciprocal path as the work moves into contact with the belt. The finishing operation, when undertaken with the oscillating platen arrangement of the present invention, provides a highly desirable and uniform finish on wood surfaces, particularly wood surfaces designed for use as articles of furniture or for other similar applications.

The platen component of a platen head machine provides the force necessary to create pressure against the work. In other words, the platen functions as a pressure beam within the system, and creates a uniform unit pressure upon the work. When the surface of the platen is non-uniform, either due to the presence of grooves or streaks, the belt is not properly backed-up and non-uniform and low unit pressures are created against the work. As a result, ridges may be formed on the surface of the work in response to the creation of low unit pressures in the area of grooves or streaks. The defects in the platen surface may be caused by a number of conditions, such as the presence of dust or loose grit from the belt. Imperfections in the abrasive grit may also result in the creation of grooves or streaks on the surface of the platen. Ideally, the platen surface should be "streakless".

In order to provide a certain "give" or resilience to the belt-contacting face of the platen, a pad of felt, rubber, or other material may be provided. One such material which is commercially available is sold commercially by the 3M Company of St. Paul, Minn. under the trade designation "Scotchmount Foam". Since the pad is fabricated of a material which may not have a high coefficient of friction, a graphite impregnated cloth is utilized as a cover for the pad, with such a cover being conveniently characterized as a "sliding cover". Thus, the felt and/or rubber pad may be provided for appropriate distribution of force, without the creation of large quantities of heat due to friction with the rapidly moving belt.

Briefly, in accordance with the present invention, means are provided to move the platen in a transverse reciprocal path or motion pattern with respect to the axis of motion of the abrasive belt. Rail means or guides are utilized to maintain the platen in a substantially horizontal plane as it moves adjacent the belt. These rail means preferably comprise "V" ways for closely controlling the transverse movement of the platen, and eliminating tendencies of the platen to become canted relative to the work surface. Additionally, adjustments are provided for moving the platen vertically to more carefully control the force which the platen applies against the workpieces.

Therefore, it is the primary object of the present invention to provide an improved platen assembly for an abrasive finishing machine wherein the platen is driven in a reciprocal path while in contact with the abrasive belt in order to enhance the quality of the finishing operation.

It is a further object of the present invention to provide an improved platen assembly for a wide belt sanding apparatus wherein the surface of the reciprocating or moving platen is covered with a graphitic impregnated cloth which provides a low frictional contact surface between the belt and the platen, thereby increasing the abrasive belt life.

It is still a further object of the present invention to provide an improved platen assembly wherein rail means are provided to insure that the platen maintains a horizontal transverse reciprocal path with respect to the abrasive belt.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
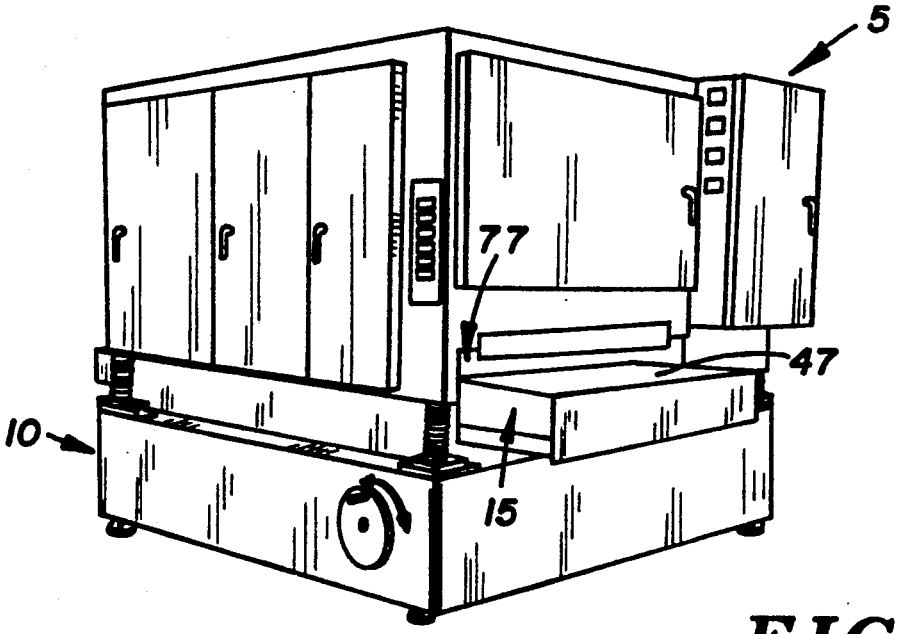
FIG. 1 is a perspective view of a typical abrasive finishing machine.
Figure 2:
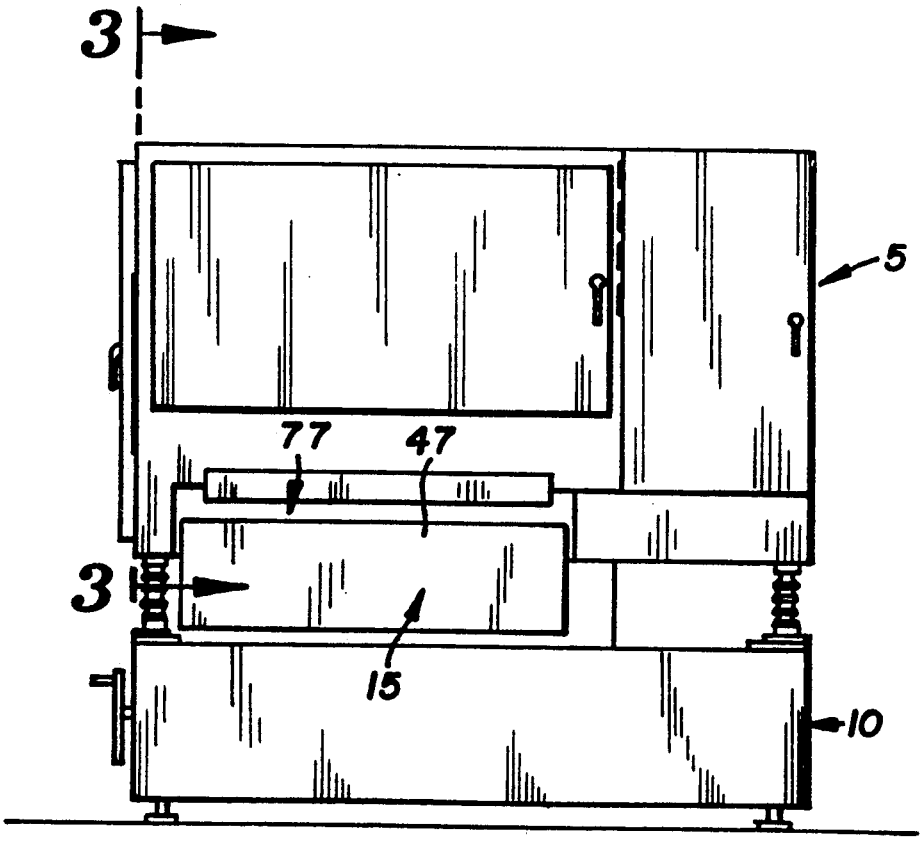
FIG. 2 is the front view of a typical abrasive finishing machine.
Figure 4:
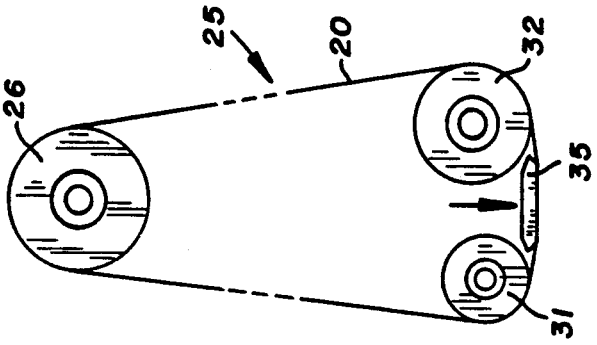
FIG. 4 is a view of the belt path with platen in a lowered position.
Figure 3:
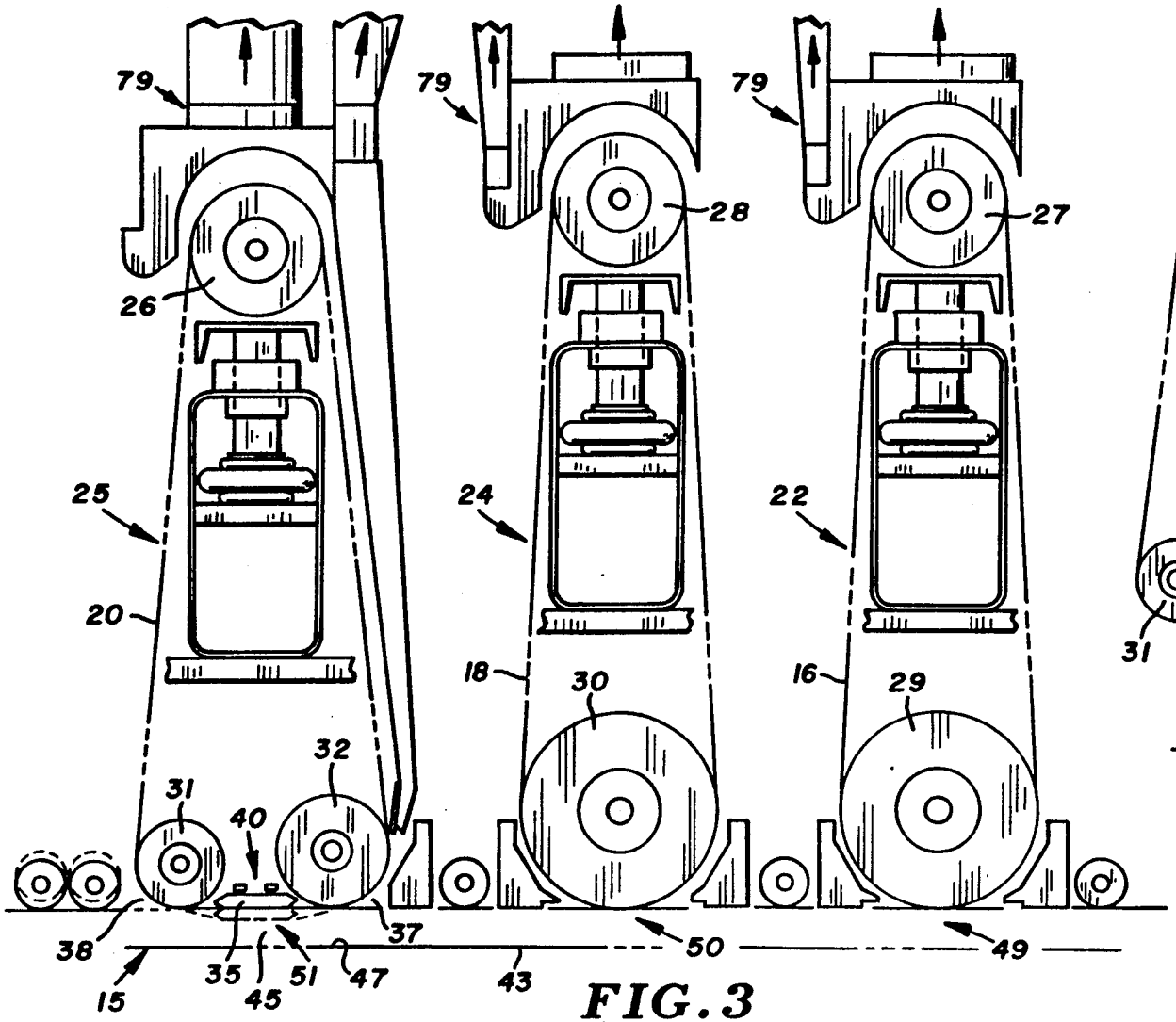
FIG. 3 is the end view of a typical abrasive finishing machine without the frame.
Figure 6:
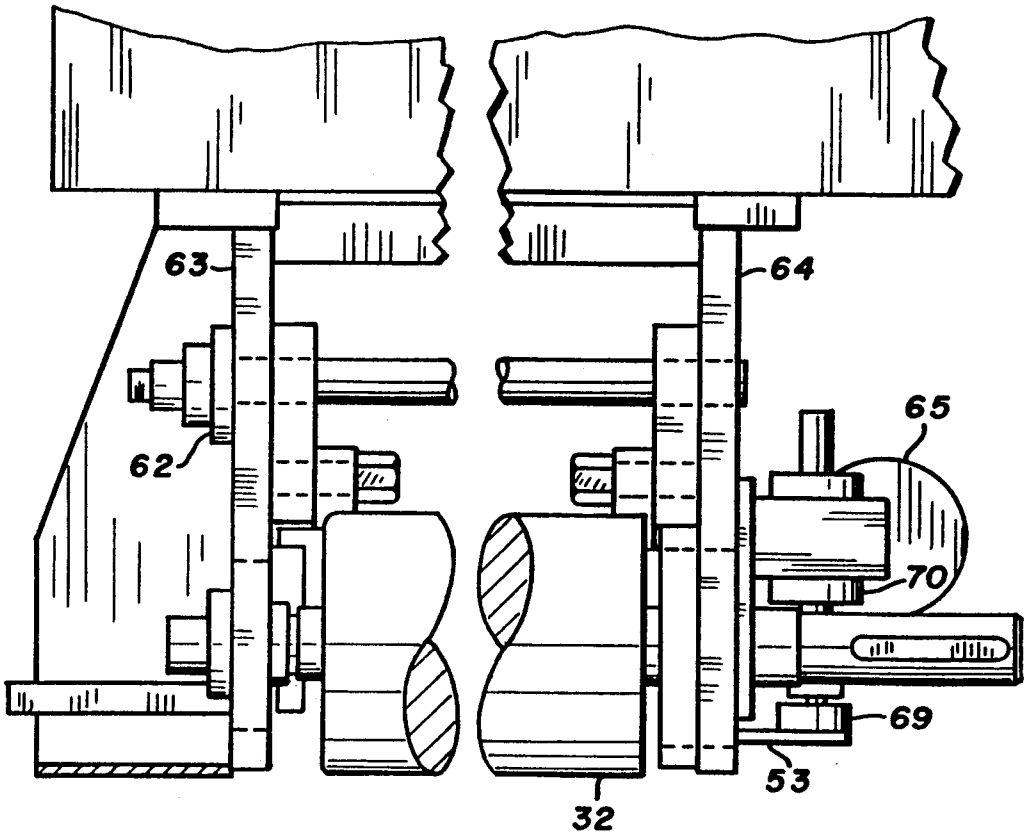
FIG. 6 is a side view showing the invention in a typical abrasive finishing machine.
Figure 5:
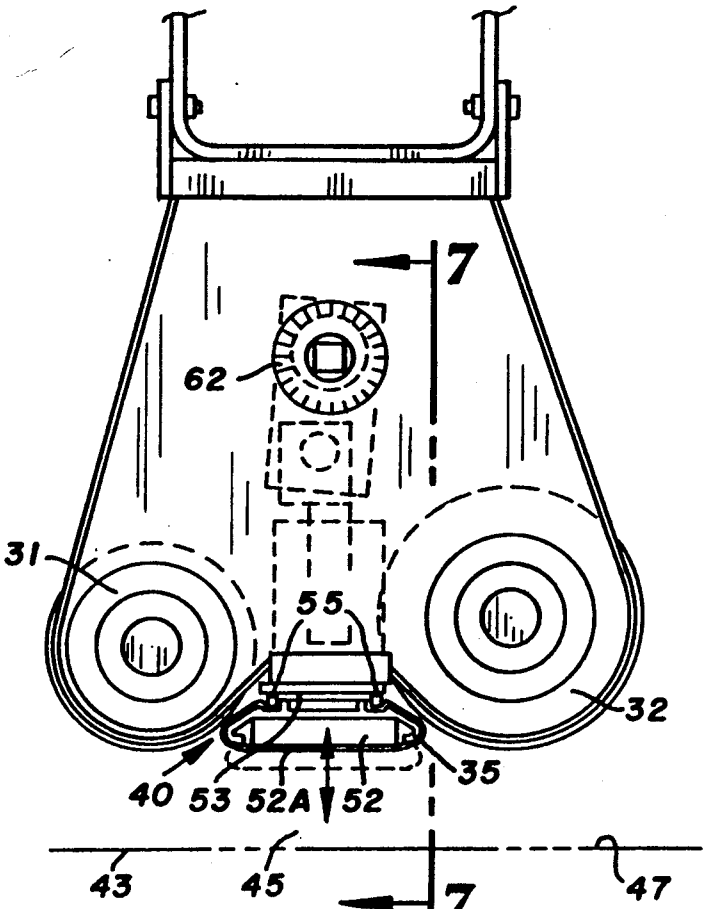
FIG. 5 is a front view of the invention as incorporated in a typical abrasive finishing machine.
Figure 7:
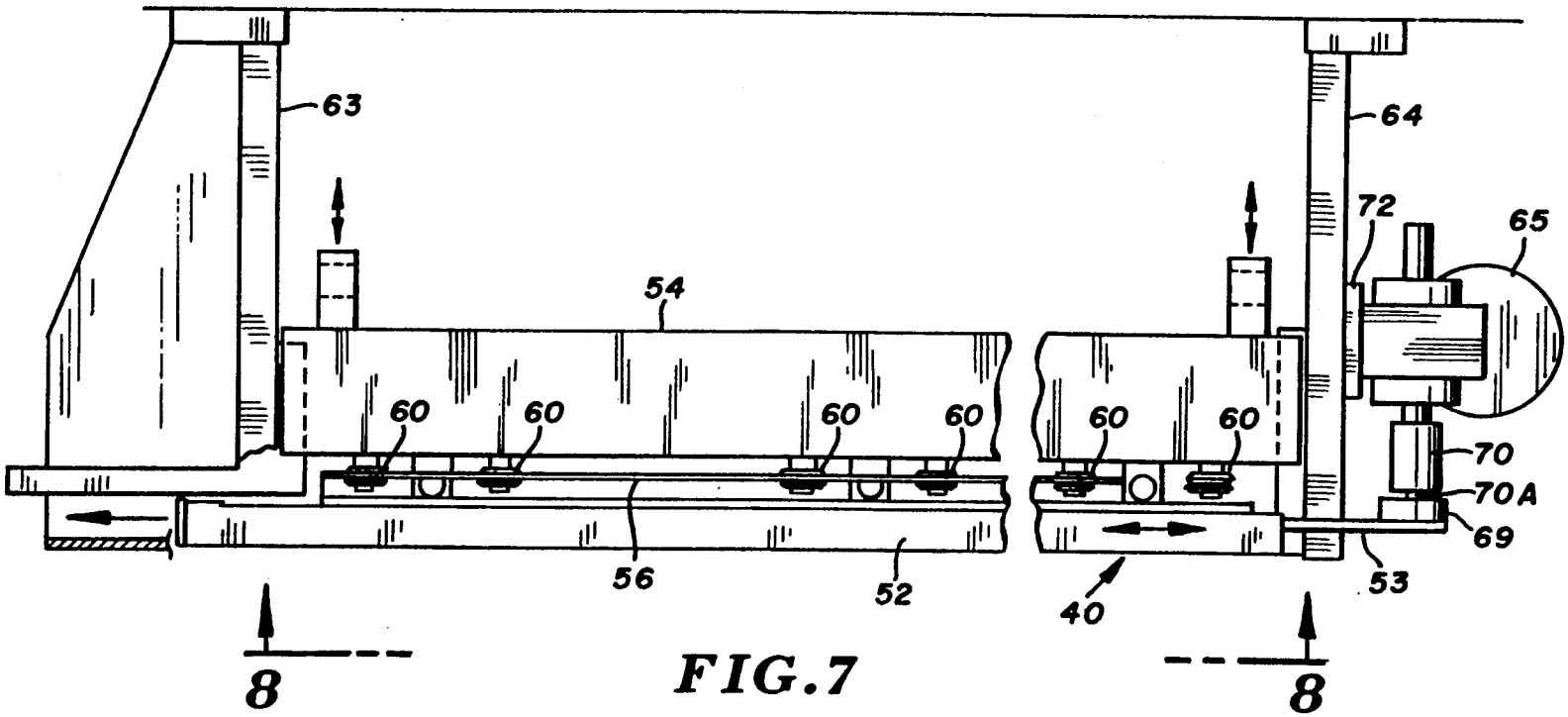
FIG. 7 is a view of the platen support taken along the line and in the direction of the arrows 7—7 of FIG. 5.
Figure 8:
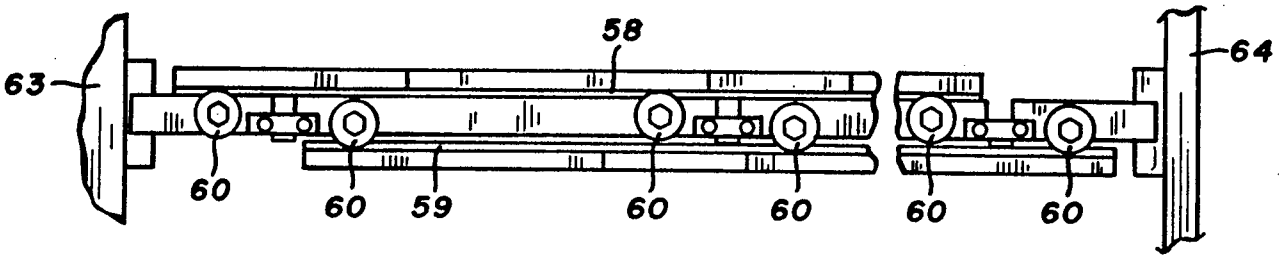
FIG. 8 is a bottom view of the platen support rail system taken along the line and in the direction of the arrows 8—8 of FIG. 7.

FIGS. 1 through 3 show a typical abrasive finishing machine 5 which utilizes the features of the present invention. The machine has a main frame structure 10 preferably in the form of a rigid structure such as a weldment for supporting a work-carrying conveyor 15 and for receiving, guiding and driving at least one wide endless abrasive belt about a predetermined orbital path relative to the conveyor. The plurality of abrasive belts 16, 18, 20 shown in FIG. 3 are typical endless wide belts having an outer abrasive surface. Such belts are, of course, in common use and commercially available. FIG. 3 shows three sanding head systems 22, 24 and 25, each of which utilizes one abrasive belt. The first two heads 22 and 24 are drum head systems and do not utilize a platen. Such heads for example, are similar to those disclosed in U.S. Pat. No. 4,512,110 to Stump, and assigned to the same assignee as the present invention. The third head 25 is arranged in accordance with the present invention. The endless abrasive belts 16 and 18 for the first and second sanding head systems 22 and 24 are each trained about two individual drums or rollers, such as main drive rollers 29 and 30 and the idler rollers 27 and 28. The endless abrasive belt 20 is arranged on head 25, and passes adjacent the surface of the platen 35. Belt 20 is trained about three individual drums or rollers, such as the main drive roller 32 and idler rollers 31 and 26. As apparent from FIG. 3 of the drawings, idler drums or rollers 31 and 26 are disposed on opposite edge surfaces, such as the leading edge 37 and trailing edge 38 respectively of a platen assembly generally designated 40.

The platen assembly 40 includes a base element comprising a platen member 35 which includes a back-up pad 52 fabricated of felt, rubber, or the like. One suitable material, as previously mentioned, is a foam rubber material available commercially under the trade designation "Scotchmount Foam" by the 3M Company of St. Paul, Minn. Pad 52 is arranged to provide modestly resilient backing for the endless abrasive belt 20, with this resilient member tending to equalize forces being applied against the work by the platen as the work moves through the apparatus.

Conveyor means 15 is provided to support work as it moves through the apparatus and into contact with the wide abrasive belts. The conveyor means 15 includes a belt having an upper span or flight upon which the work is carried as shown at 47, with the path of the belt being controlled by conveyor rolls (not shown). Such conveyor systems are well known in the art.

Belt 20 which is provided for sanding head 25, is powered by drum 32 so as to move belt 20 about the individual rollers while it is trained about each of the three cylindrical drums. Furthermore, in the zone or area occupied by platen 35, the working zone 45 between the abrasive belt 20 and upper surface 47 of conveyor belt 43 may be collectively defined as one "working station". In particular, this working station is a zone shown generally at 51. Sanding heads 22 and 24 also contain working stations as at 49 and 50.

While workpieces are located within the working stations 49, 50 and 51, the upper surface of the workpiece is arranged to be in contact with and opposed to the abrasive coated outer surface of the endless abrasive belts. In this fashion, therefore, the surface of the workpiece is basically treated, abraded, and/or sanded to its desired surface finish.

The main frame 10 provides a support to which endless abrasive belts, the cylindrical drums carrying the belts 16, 18 and 20, and the platen 35 are secured in their operative configuration. Specifically, the platen assembly 40 is arranged to move transversely in a reciprocatory to-and-fro path about a horizontal plane which is parallel to the surface of the work being treated. The mechanism for providing reciprocal motion to the platen assembly 40 is illustrated in greater detail in FIGS. 5 through 8.

The platen assembly 40 includes a graphitic impregnated cloth cover 52A, a pad supporting slide bar 53, a platen adjustment bar 54, a plurality of "V" wheels 60 and a modified track 56. The graphitic cover 52A may be pulled off of slide bar 53 for service or replacement, with the cover being retained in place by bolt strips 55—55. The modified track 56 is formed on the upper surface of the slide bar 53 by two parallel spaced rails or "V" way 58 and 59.

The plurality of "V" wheels 60 depend from the platen adjustment bar 54 and engage the two parallel rails 58 and 59. The outer peripheral surface of the wheels 60 is provided with a "V" shaped groove, thereby creating an outer surface for the wheels 60 which defines the characteristic surface of the "V" wheels 60. The platen adjustment bar 54 is linked to a dial 62 for vertical adjustment of the platen sliding pad 52 with respect to the endless abrasive belt 20. The platen adjustment bar 54 extends between the two support brackets 63 and 64 of the main frame 10. The main frame 10 includes slots (not shown) which receive the adjustment bar, thereby supporting the platen assembly in the abrasive finishing machine.

The reciprocal motion generating means for platen 40 includes drive motor 65, coupled through an adjustable bracket (not shown) to main frame 10. An eccentric assembly 70 is coupled by bracket 72 to the main frame 10 while being operatively connected to the motor. Bearing 69 connects the eccentric drive 70 through eccentric drive pin 70A to the platen slide bar 53, providing reciprocal movement to the lower portion of the platen assembly 40.

OPERATION OF THE DEVICE

The dial 62 is used to adjust the height of the platen slide bar 53 with respect to the conveyor belt 43 on which the workpieces will be conveyed through the work station 51. Once the desired height is obtained, work is fed into the abrasive finishing machine 5. The workpiece enters the abrasive finishing machine at 77, moves through the first two sanding heads 22 and 24. Suitable dust removal hoods 79 are typically provided to remove the build-up of accumulated dust particles. Such dust removal hoods are conventional and in accordance, for example, with those disclosed in U.S. Pat. No. 3,872,627 to Schuster, assigned to the same assignee as the present invention.

The workpiece ultimately reaches the third sanding head 25 containing the platen assembly 40. The platen 35 with the graphite impregnated cover 52A moves continuously transverse to the belt axis while in contact with the finishing belt 20. Platen 35 is guided along its reciprocatory path by the "V" wheels 60 which engage the "V" ways or rails of the modified track. In this fashion, the transverse motion is controlled. The impregnated cover 52A provides a low friction contact surface between the platen and the inner surface of the endless abrasive belt 20.

The rate of the oscillation or reciprocation of the platen as well as the length of the stroke are preferably adjustable. Typically, the stroke is designed to be approximately one-half inch, with the oscillatory rate being between about 1 and 120 cpm. The rate is further made proportional, if desired, with the abrasive belt speed, increasing the an increase in belt speed. Belt speeds are typically in the range of about 3000 fpm, although satisfactory results may be obtained with belt speeds ranging from as low as 2800 fpm up to about 4300 fpm. The oscillatory rate may also vary with conveyor belt speed, that is, as the conveyor belt speed increases, it may be desirable to increase the oscillatory rate accordingly.

Tests have shown the advantages of the present invention. The graphite impregnated cloth 52A mounted on an oscillating platen of the present invention has been found to last approximately four weeks as compared to the previous one week. In addition, the abrasive belt life improves considerably with the present invention. In a conventional machine, a 180-grit abrasive belt under severe conditions may require a change several times per day. Belts employed in combination with the system of the present invention have been found to last for between 20 and 40 hours. The resulting finish is of a quality far superior to a finish from machines equipped with conventional platens. Edge wear on the graphite impregnated cover 52A is more widely distributed when utilized in combination with the apparatus of the present invention.

The invention has been described here in considerable detail in order to comply with the Patent Statutes and to provide those skilled in the art with the information needed to apply the novel principles and to construct and use such specialized components as required. However, those skilled in the art will appreciate that the invention can be embodied in forms other than as herein disclosed for purposes of illustration without departing from the scope of the invention.

What is claimed is:

1. An endless abrasive belt surface treating apparatus comprising:

(a) a main frame means;

(b) guide means for receiving, guiding and driving an endless abrasive belt with an abrasive coated outer surface about a predetermined path while trained about a plurality of cylindrical drums having axes of predetermined length and with said cylindrical drums being arranged along spaced apart parallelly disposed axes;

(c) drive means for drivably rotating at least one of said cylindrical drums;

(d) a platen means having a longitudinal axis of a length substantially equal to said predetermined length and with a substantially planar surface, said platen means being disposed between a pair of said cylindrical drums and being arranged to apply a working force against the inner surface and across substantially the entire width of an endless abrasive belt when trained about said cylindrical drums and said guide means;

(e) said platen means including a graphitic cover for low frictional running contact with the inner surface of an abrasive belt running within said predetermined path;

(f) means for imparting reciprocatory movement to said platen means relative to said pair of cylindrical drums and along an axis parallel to the axes of said cylindrical drums, with said reciprocatory movement occurring while said endless belt continues to travel along said predetermined path; and (g) conveyor means having a conveyor belt for supporting workpieces with surfaces in contact with and opposed to said abrasive coated outer belt surface running beneath said platen means, with said conveyor belt and platen defining a working station between opposed surfaces of said abrasive belt and said conveyor belt.

2. An endless abrasive belt surface treating apparatus comprising:

(a) a main frame means;

(b) guide means for receiving, guiding and driving an endless abrasive belt with an abrasive coated outer surface about a predetermined path while trained about a plurality of cylindrical drums having axes of predetermined length and with said cylindrical drums being arranged along spaced apart parallelly disposed axes;

(c) drive means for drivably rotating at least one of said cylindrical drums;

(d) a platen means having a longitudinal axis of a length substantially equal to said predetermined length and with a substantially planar surface, said platen means being disposed between a pair of said cylindrical drums and being arranged to apply a working force against the inner surface and across substantially the entire width of an endless abrasive belt when trained about said guide means;

(e) said platen means including a graphitic cover for low frictional running contact with the inner surface of an abrasive belt running within said predetermined path;

(f) means for imparting reciprocatory movement to said platen means along an axis parallel to the axes of said pair of drums while said endless belt continues to travel along said predetermined path, said means for imparting reciprocatory movement to said platen including a slide bar coupled to said platen, a track guide comprising two spaced apart parallel rails extending from said top of said slide bar, means for vertically adjusting said slide bar connected to said main frame means, a plurality of wheels received between said spaced apart parallel rails and depending from said means for vertically adjusting said slide bar; and (g) conveyor means having a conveyor belt for supporting workpieces with surfaces in contact with and opposed to said abrasive coated outer belt surface running beneath said platen means, with said conveyor belt and platen defining a working station between opposed surfaces of said abrasive belt and said conveyor belt.

3. The apparatus as defined in claim 1 being particularly characterized in that reciprocating motion generating means are coupled to said main frame means and arranged to impart motion to said platen means in a plane of motion parallel to the axes of said spaced pair of cylindrical drums.

4. The apparatus as defined in claim 2 being particularly characterized in that said reciprocating motion generating means comprises an eccentric drive, said platen slide bar bearingly connected thereto.

* * * * *